US007268297B2

(12) United States Patent
Jeong

(10) Patent No.: US 7,268,297 B2
(45) Date of Patent: Sep. 11, 2007

(54) HIGH VOLTAGE CABLE FOR A VEHICLE

(75) Inventor: Yong Uk Jeong, Gyeonggi-do (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 11/298,647

(22) Filed: Dec. 8, 2005

(65) Prior Publication Data

US 2007/0102185 A1 May 10, 2007

(30) Foreign Application Priority Data

Nov. 4, 2005 (KR) ..... 10-2005-0105515

(51) Int. Cl.
*H01R 9/05* (2006.01)

(52) U.S. Cl. ..... 174/75 C; 174/78

(58) Field of Classification Search ..... 174/75 C, 174/78; 29/867
See application file for complete search history.

(56) References Cited

U.S. PATENT DOCUMENTS 2,901,528 A * 8/1959 Lazar ..... 174/75 C
3,150,231 A * 9/1964 Clark ..... 174/75 C
4,583,811 A * 4/1986 McMills ..... 439/584
2002/0050062 A1* 5/2002 Sato et al. ..... 29/857

FOREIGN PATENT DOCUMENTS

| | | |
|---|---|---|
| JP | 08-096868 | 4/1996 |
| JP | 2003-197037 | 7/2003 |
| JP | 2004-172476 | 6/2004 |

* cited by examiner

*Primary Examiner*—Chau N. Nguyen
(74) *Attorney, Agent, or Firm*—Peter F. Corless; Edwards Angell Palmer & Dodge LLP

(57) ABSTRACT

A high voltage cable for a vehicle is disclosed which comprises a braid body portion; a shield body portion; and a holder portion. In preferred systems, the structure of a shield body portion with a braid portion of the high voltage cable for the vehicle being engaged and a holder portion can be changed, and the shield body portion, the braid portion, and a holder portion are engaged with each other, whereby wear of the braid portion such as arising from vehicle vibration can be minimized or prevented and thereby avoid shorting of the braid portion.

7 Claims, 3 Drawing Sheets

HIGH VOLTAGE CABLE FOR A VEHICLE

CROSS-REFERENCE TO RELATED APPLICATION

This application claims priority to and the benefit of Korean Patent Application 10-2005-0105515 filed in the Korean Intellectual Property Office on Nov. 4, 2005, the entire content of which is incorporated herein by reference.

FIELD OF THE INVENTION

The present invention relates to a high voltage cable for a vehicle which comprises a braid body portion; a shield body portion; and a holder portion. In preferred systems, a shield body portion, a braid portion, and a holder portion are engaged with each other to maintain adhesion power, so that the wear of the braid portion due to e.g. vehicle vibration can be reduced or prevented, thereby avoiding shorting of the braid portion.

BACKGROUND

A high voltage cable installed in a vehicle is constructed such that an outer side of a core insulated by an inner cover is covered by the braid portion, and outer side thereof is insulated by a sheath in order to shield electronic waves or electric noises.

In a prior system, when the braid portion provided to the high voltage cable for the vehicle is positioned between a shield cell and a braid holder to form surface contacting, an interference to the braid portion can be produced by the vibration arising from the driving of the vehicle which can cause wear of the braid portion so that the braid portion is easily shorted or the shielding capacity thereof is substantially reduced.

Further, when the braid portion is pressure adhered between the shield cell and the braid holder to secure the braid portion, a folding region can be formed to thereby produce tensile force in the non-adhered region due to the vibration of the vehicle, so that the braid portion can become separated from the holder.

The information set forth in this Background of the Invention section is only for enhancement of understanding of the invention and should not be taken as an acknowledgement or any form of suggestion that this information forms the prior art that is already known to a person skilled in the art.

SUMMARY OF THE INVENTION

In one aspect a high voltage cable for a vehicle is provided, in which a shield body portion, a braid portion, and a holder portion are engaged with each other to maintain adhesion, and preferably so that the wear of the braid portion due to the vibration produced from the vehicle can be prevented or reduced, and further preferably that the braid portion and the holder portion engaged with the shield body portion can be simply engaged with each other such as by first and second jigs.

In a first aspect, a voltage cable for a vehicle is provided which suitably comprises (a) a braid body portion; (b) a shield body portion that engages the braid body portion; and (c) a holder portion that engages the braid body portion.

In a preferred aspect, the high voltage cable for the vehicle comprises a shield body portion formed to penetrate so that the braid portion of the high voltage cable can be securely engage such shield body portion.

In preferred systems of the invention, there is provided a first jig which may be suitably inserted into the front inside of the shield body portion to be closely adhered and engaged such as with an inner peripheral surface of the shield body portion, and preferably having a recess formed inwardly at the upper and lower surfaces of the shield body portion. Further, in preferred system, a holder portion is provided and suitably formed to be penetrated at the inside so that it can be engaged at the outside of the braid portion of the high voltage cable for the vehicle, which is suitably located at an outer peripheral surface of the shield body portion.

In preferred systems of the invention, a second jig may be provided and suitably engaged with an outer peripheral surface of the holder portion, and suitably equipped with a pressuring member for pressing the shield body portion, the braid body and the holder portion toward a recess of the first jig so that the adhesion force produced between them can be maintained after they are engaged with each other closely.

The invention also includes vehicles that comprise a high voltage cable as described herein.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like. High voltage cables will be particularly useful a wide variety of motor vehicles including automobiles, trucks and the like.

Other aspects of the invention are discussed below.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Figure 1:
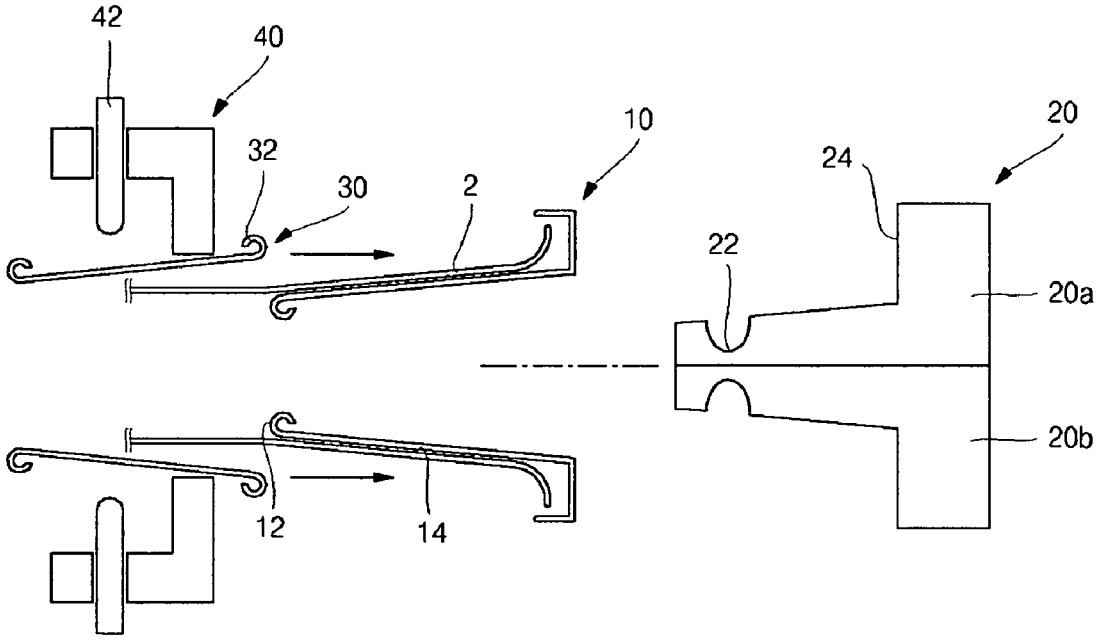
FIG. 1 is a view showing a constitution of a high voltage cable for a vehicle according to the present invention.

As discussed above, a voltage cable for a vehicle is provided which suitably comprises (a) a braid body portion; (b) a shield body portion that engages the braid body portion; and (c) a holder portion that engages the braid body portion.

Preferred cable systems may further comprise a first jig element that preferably engages an inner peripheral surface of the shield body portion. Particularly preferred first jig elements may comprise a recess formed inwardly at the upper and lower surfaces of the shield body portion.

Preferred cable systems of the invention also may further comprise a second jig element. Particularly preferred second jig elements may suitably engage an outer peripheral surface of the holder portion. Preferably, a second jig element may comprise a pressuring member for pressing the shield body portion, the braid body and the holder portion toward a recess of the first jig.

In preferred cable systems, the holder portion may suitably be located at an outer peripheral surface of the shield body portion.

A preferred embodiment of the present invention now will be described with reference to the accompanying drawings. In the following description and drawings, the same reference numerals are used to designate the same or similar components, and so repetition of the description on the same or similar components will be omitted.

Referring now to FIG. 1, the high voltage cable for the vehicle of the present invention suitably includes a shield body portion 10 formed to penetrate into the inside so that a braid portion 2 of the high voltage cable for the vehicle can be engaged into it.

The shield body portion 10 is suitably extended to the rear side so that it is inclined to the inside along the longitudinal direction, and includes an extension 14 having a first wear prevention portion 12 which is bent to the inside at one end to prevent wear of the braid portion 2.

The first wear prevention portion 12 is suitably formed to be round toward the front inside of the extension 14.

Further, in a preferred system as discussed above, the high voltage cable of the present invention is suitably provided with a first jig 20 which is inserted into the front inside of the shield body portion 10 to engage with an inner peripheral surface of the shield body portion 10, and which has a recess 22 formed inwardly at the lower and upper surfaces.

The first jig 20 suitably comprises a first upper jig 20*a* separated from the upper side of the shield body portion 10 and adhered after it is engaged with the inside of the shield body portion 10, and a first lower jig 20*b* separated from the lower side of the shield body portion 10 and adhered.

The first jig 20 is also preferably provided with a step portion 24 surface-contacting with the outside of the shield body portion 10 when it is inserted into the inside of the shield body portion 10. The recess 22 of the first jig 20 is formed to be more than two pieces at the lower and upper surfaces.

A holder portion 30 formed to penetrate at the inside is also preferably provided so that it can be engaged with the outside of the braid portion 2 of the high voltage cable, which is arranged at the outer peripheral surface of the shield body portion 10.

The holder portion 30 is preferably formed with a second wear prevention portion 32, both ends of which are opened and bent to the outside. The second wear prevention portion 32 is formed to be round to the outside of the holder portion 30.

The prevention portion 12 and the second wear prevention portion 32 are preferably formed with a substantially round shape to more effectively reduce or prevent the interference of the braid portion 2, which is surface-contacted with the first and second wear prevention portions 12, 32.

Preferred high voltage cables of the present invention may further comprise a second jig 40 suitably engaged with the outer peripheral surface of the holder portion 30 and having a pressurizing member 42 for pressing toward the recess 22 of the first jig 20 so that the adhesion force produce between the shield body portion 10, the braid portion 2, and the holder portion 30 can be maintained after they have been closely engaged with each other.

The fist and second jigs 20, 40 are useful elements for closely engaging the shield body portion 10, the braid portion 2, and the holder portion 30.

A preferred engagement procedure of a high voltage cable for the vehicle according to the present invention constructed as described above is now described with reference to the drawings.

Figure 2A:
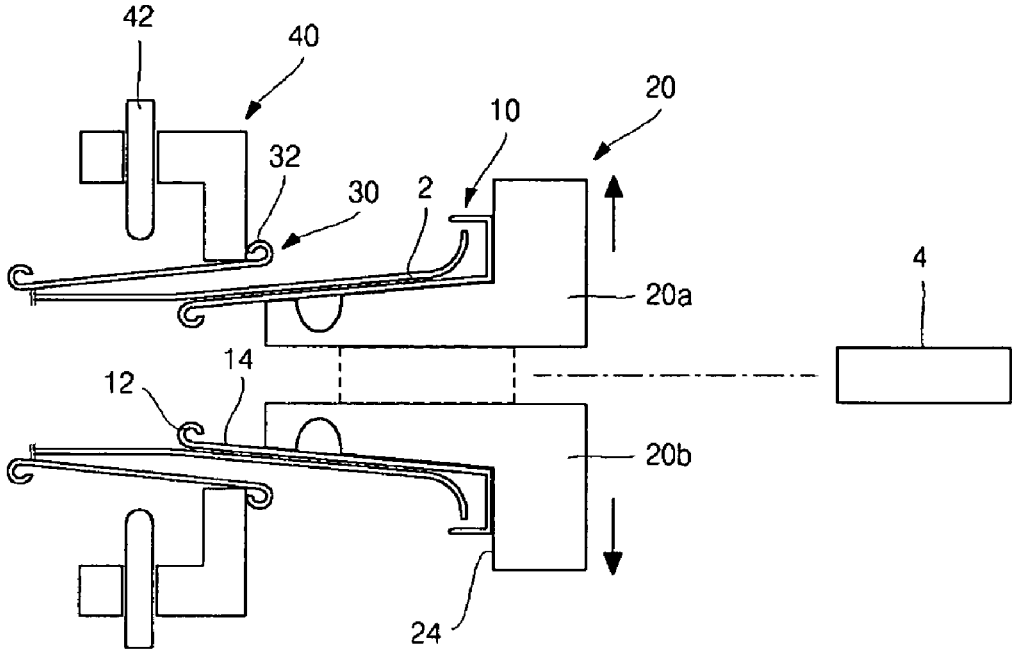
FIGS. 2*a* to 2*d* are views showing the engagement process of a shield body portion, a braid portion and a holder portion constituting the high voltage cable for the vehicle according to the present invention.
Figure 2B:
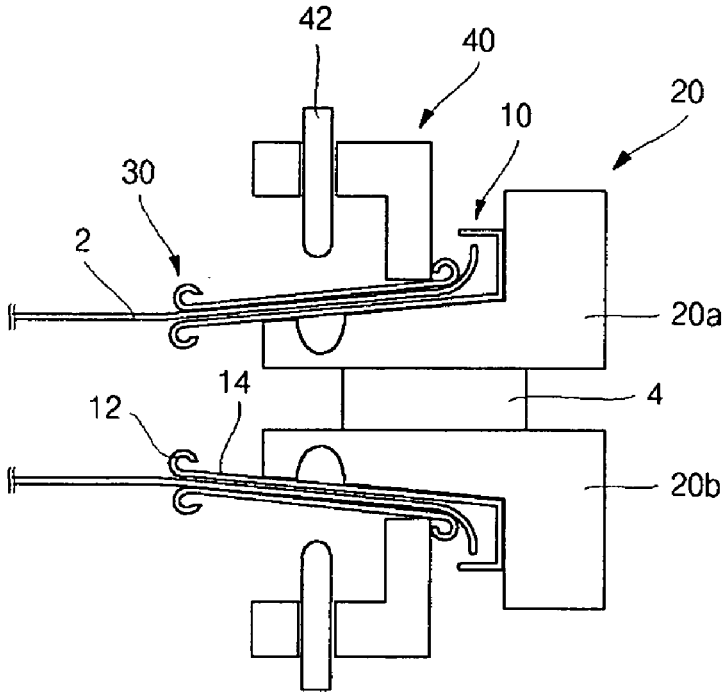
Figure 2C:
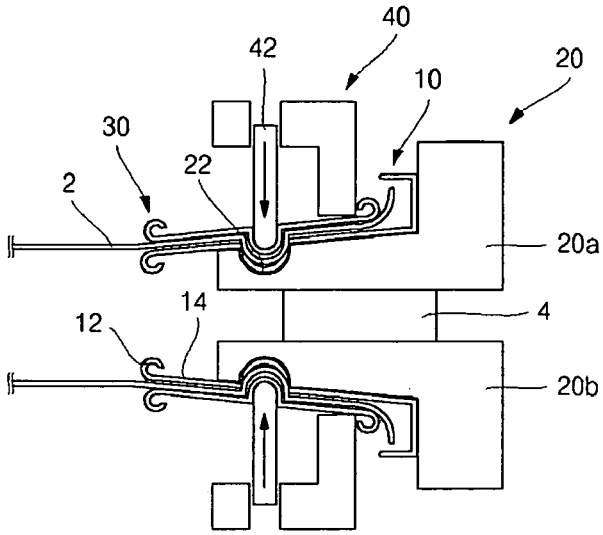

Referring to FIG. 2*a*, the high voltage cable is suitably installed from the front of the shield body portion 10 to be located to adhere closely to the inner peripheral surface of the shield body portion by using the first jig 20.

After the first jig 20 is engaged to the inside of the shield body portion 10, each of the second jig 40 and the first jig 20 is separated from each other in the arrow direction to thereby accomplish the installment.

When the high voltage cable for the vehicle is used after the assembly has been completed and it is installed to the vehicle, although the vibration produced from the operation of the engine (not shown) of the vehicle is transmitted to the high voltage cable for the vehicle to thereby cause vibration phenomenon of the braid portion 2 in any decided direction periodically, the first wear prevention portion 12 of the shield body portion 10 and the second wear prevention portion 32 of the holder portion 30 are preferably formed to be round as discussed above so that wear in the braid portion 2 cannot be produced in spite of the continuous shaking of the braid portion 2 due to the vibration.

Also, reduction of the shield capacity for the electronic waves will not occur due to the short of the braid portion 2.

Figure 2D:
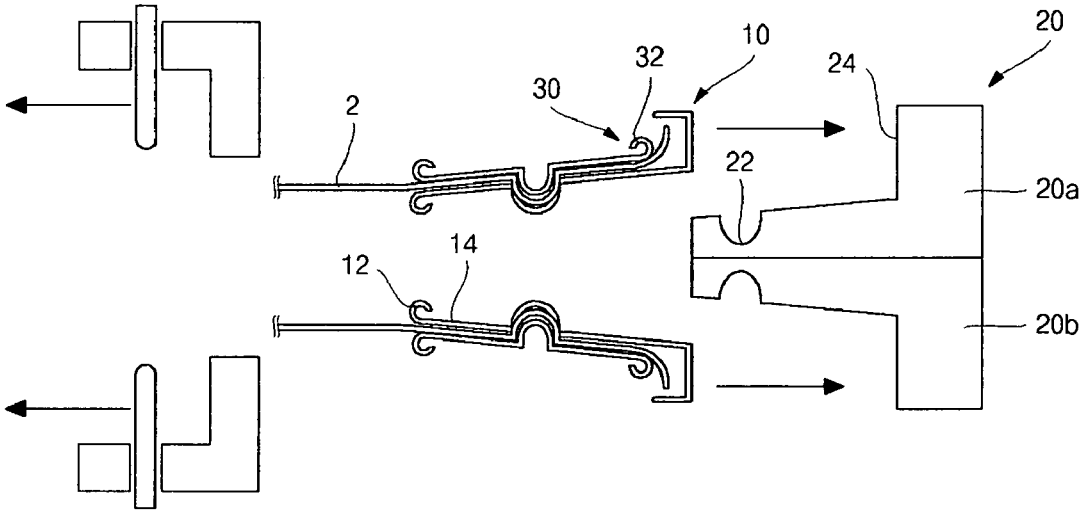

Further, as shown in FIG. 2*d*, folding of the braid portion 2 does not occur because the shield body portion 10, the braid portion 2 and the holder portion 30 are engaged closely to each other.

As described above, according to the high voltage cable for the vehicle of the present invention, short of the braid portion due to the wear does not occur because among other things the shield body portion, the braid portion and the holder portion are engaged with each other closely, and each of the shield body portion and the holder portion is formed with the first and second wear prevention portions.

Moreover, the shield body portion, the braid portion and the holder portion are engaged with each other closely, and the adhesion force between them has been enhanced by the recess to thereby prevent the braid portion from being separated due to the vibration of the vehicle.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A high voltage cable for a vehicle comprising:

a shield body portion formed to be penetrated at the inside so that a braid body formed at the high voltage cable for the vehicle can be engaged with, the shield body portion comprising an extension having a first wear prevention portion formed to extend to the back and to be inclined inwardly along the longitudinal direction, an end of which is bent inwardly so that the braid body can be prevented from wear;

a first jig inserted into the front inside of the shield body portion to be closely adhered and engaged with an inner peripheral surface of the shield body portion, and having a recess formed inwardly at the upper and lower surfaces of the shield body portion, the first jig comprises a first upper jig separated and adhered closely to the upper side of the shield body portion after it is engaged to the inside of the shield body portion, and a first lower jig separated and adhered closely to the lower side of the shield body portion;

a holder portion formed to be penetrated at the inside so that it can be engaged at the outside of the braid portion of the high voltage cable for the vehicle, which is located at an outer peripheral surface of the shield body portion; and a second jig engaged with an outer peripheral surface of the holder portion, and equipped with a pressuring member for pressing the shield body portion, the braid body and the holder portion toward the recess of the first jig.

2. The high voltage cable for the vehicle according to claim 1, wherein the first wear prevention portion is formed to be round to the inside of the extension.

3. The high voltage cable for the vehicle according to claim 1, wherein the recess of the first jig is formed to be more than two pieces at the upper and lower surfaces of the first jig.

4. The high voltage cable for the vehicle according to claim 1, wherein the holder portion is formed with a second wear prevention portion, both rear and front ends of which are opened and bent to the outside.

5. The high voltage cable for the vehicle according to claim 4, wherein the second wear prevention portion is formed to be round to the outside of the holder portion.

6. A high voltage cable for a vehicle comprising:

a shield body portion formed to be penetrated at the inside so that a braid body formed at the high voltage cable for the vehicle can be engaged with, the shield body portion comprising an extension having a first wear prevention portion formed to extend to the back and to be inclined inwardly along the longitudinal direction, an end of which is bent inwardly so that the braid body can be prevented from wear;

a first jig inserted into the front inside of the shield body portion to be closely adhered and engaged with an inner peripheral surface of the shield body portion, and having a recess formed inwardly at the upper and lower surfaces of the shield body portion;

a holder portion formed to be penetrated at the inside so that it can be engaged at the outside of the braid portion of the high voltage cable for the vehicle, which is located at an outer peripheral surface of the shield body portion; and a second jig engaged with an outer peripheral surface of the holder portion, and equipped with a pressuring member for pressing the shield body portion, the braid body and the holder portion toward the recess of the first jig.

7. A high voltage cable for a vehicle comprising:

a shield body portion formed to be penetrated at the inside so that a braid body formed at the high voltage cable for the vehicle can be engaged with;

a first jig inserted into the front inside of the shield body portion to be closely adhered and engaged with an inner peripheral surface of the shield body portion, and having a recess formed inwardly at the upper and lower surfaces of the shield body portion, the recess being formed to be more than two pieces at the upper and lower surfaces of the first jig;

a holder portion formed to be penetrated at the inside so that it can be engaged at the outside of the braid portion of the high voltage cable for the vehicle, which is located at an outer peripheral surface of the shield body portion; and a second jig engaged with an outer peripheral surface of the holder portion, and equipped with a pressuring member for pressing the shield body portion, the braid body and the holder portion toward the recess of the first jig.

* * * * *